US006634588B1

(12) United States Patent
Jackson

(10) Patent No.: US 6,634,588 B1
(45) Date of Patent: Oct. 21, 2003

(54) WINCH ROTATOR FOR ALL TERRAIN VEHICLES

(76) Inventor: Stephen L. Jackson, 171 Manor Dr., Libby, MT (US) 59923

( * ) Notice: Subject to any disclaimer, the term of this patent is extended or adjusted under 35 U.S.C. 154(b) by 89 days.

(21) Appl. No.: 09/944,689

(22) Filed: Aug. 31, 2001

(51) Int. Cl.[7] ..... B66D 1/00
(52) U.S. Cl. ..... 242/323
(58) Field of Search ..... 254/323, 380, 254/383, 338

(56) References Cited

U.S. PATENT DOCUMENTS 2,470,242 A * 5/1949 Felsing ..... 254/323
3,181,707 A * 5/1965 Janssen ..... 212/202
4,455,961 A * 6/1984 Hansen et al. ..... 114/254
4,706,939 A * 11/1987 Gagne ..... 254/332
5,072,962 A * 12/1991 Webb ..... 280/414.1
5,593,139 A 1/1997 Julian
5,927,693 A * 7/1999 Hackl ..... 254/398
6,138,991 A * 10/2000 Myers, Jr. ..... 254/323

* cited by examiner

*Primary Examiner*—Emmanuel Marcelo
(74) *Attorney, Agent, or Firm*—Wells St. John, P.S.

(57) ABSTRACT

A winch rotator is described for a receiver hitch mounted all terrain vehicle winch having a winch cable and a cable guiding fairlead through which the winch cable is threaded. The rotator includes an auxiliary receiver hitch post configured to be mounted to the receiver hitch. A support is mounted to the receiver hitch post and extends to an end where a winch mount is located, to mount a winch with the fairlead thereof oriented in a rotated, downwardly disposed position.

13 Claims, 8 Drawing Sheets

WINCH ROTATOR FOR ALL TERRAIN VEHICLES

CROSS REFERENCE TO RELATED APPLICATION

This application is an originally filed application and is not related to any U.S. or foreign filed patent application, provisional patent, or invention registration.

TECHNICAL FIELD

The present invention relates to all terrain vehicle winch mounting arrangements and more particularly to a mount that facilitates rotation of a winch to an alternate winch mount position.

BACKGROUND OF THE INVENTION

More uses are being found for all terrain vehicles (ATVs), especially for those equipped with all wheel drive. For example, receiver hitch winches are typical accessories are currently available for mounting to such vehicles, for use in retrieving items or pulling the associated ATV from a mired position. Another use for an ATV winch is to provide lifting and lowering control of ATV plow blades.

The typical ATV plow blade is pivoted on the ATV frame for elevational movement about a relatively horizontal pivot axis. The winch line is attached to the blade and the winch is operated to lift the blade to a raised inoperative position, or to lower the blade to a ground engaging operative position. To do this, the winch line must make a sharp bend over one of the cable guiding fairlead. This causes premature stress and eventual breakage of the winch line. Further, with the winch in a normal mounted position, only a small amount of elevational movement of the blade may be achieved before the blade, the winch line hook or the winch line ferrule comes into contact with the winch. This also caused premature wear or stress that is best avoided.

A need has been realized for a device that will permit repositioning of an ATV winch such that the winch line will depend from the winch without bending sharply over a winch fairlead. A further need is realized for a device that will reposition a winch at a higher elevation and at an angular position for operation to lift and lower a tool such as a plow.

BRIEF DESCRIPTION OF THE DRAWINGS

Preferred embodiments of the invention are described below with reference to the following accompanying drawings.

DESCRIPTION OF PREFERRED EMBODIMENTS

Figure 1:
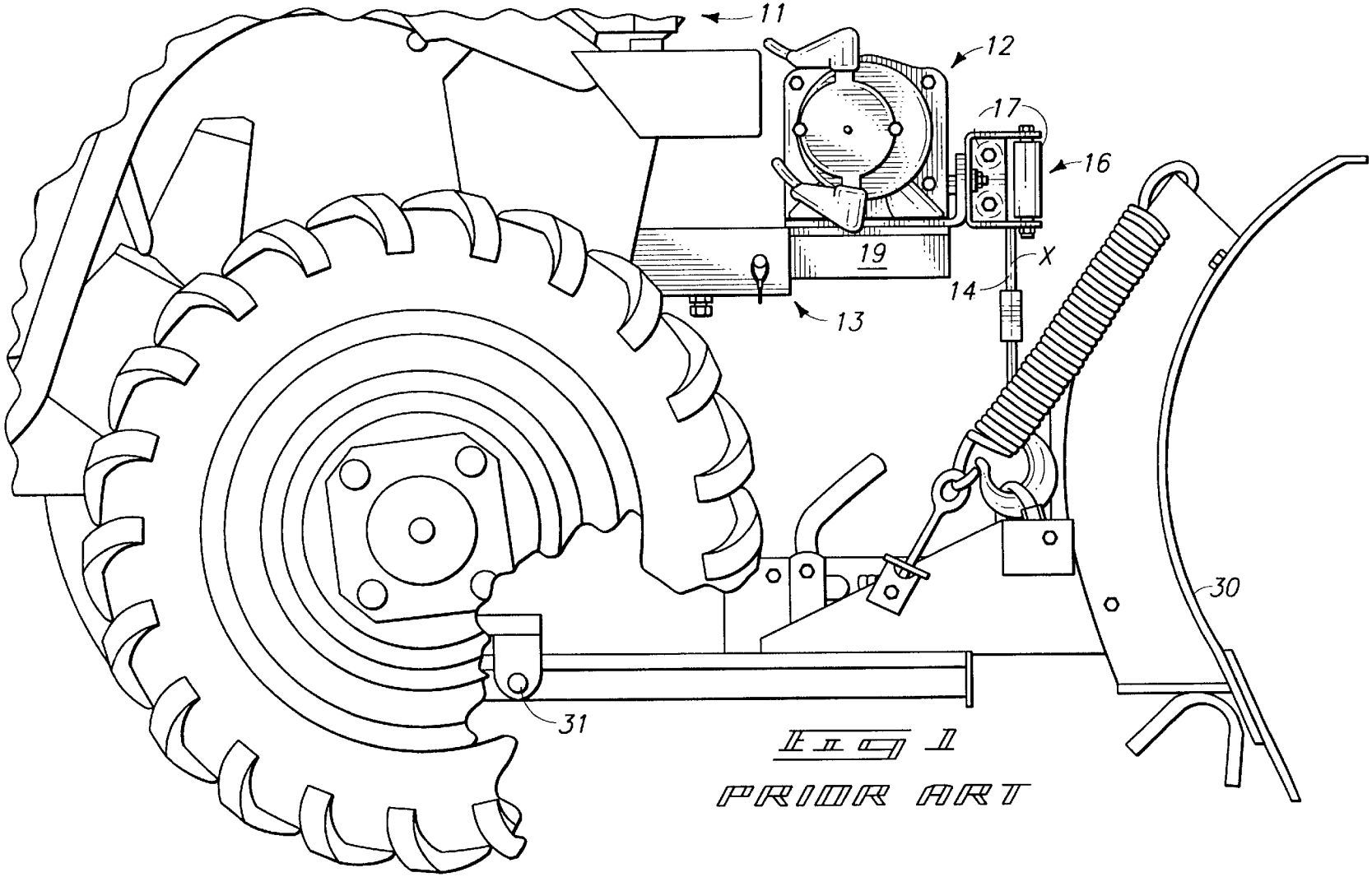
FIG 1 PRIOR ART
FIG. 1 is a segmented side elevation view showing a front part of an all terrain vehicle (ATV), a schematic plow blade in a raised position and a conventional prior art mount for a winch.

This disclosure of the invention is submitted in furtherance of the constitutional purposes of the U.S. Patent Laws "to promote the progress of science and useful arts" (Article 1, Section 8).

It is pointed out that certain connecting, fastening, manufacturing and other means and components utilized in this invention are widely known and used in the field of the invention described, their exact nature or type is not necessary for an understanding and use of the invention by a person skilled or science, and they will not therefore be discussed in significant detail. Furthermore, the various components shown are described herein for any specific application of this invention and may be varied or altered as anticipated by this invention.

By way of example, certain terms such as "vertical, horizontal, up, down, forward and rearward" should be considered as having ordinary meaning but also that such terms are used in conjunction with the orientation of the drawing sheets and the placement of the described components in relation to an all terrain vehicle supported on a horizontal surface. Obviously, the components when considered alone may be otherwise oriented.

Furthermore, the terms "a", "an", and "the" as used in the claims herein are used in conformance with longstanding claim drafting practice and interpretation, and not in a limiting way. Unless specifically set forth herein the aforementioned terms are not limited to one of such items, but instead, are intended to mean "at least one".

Before describing preferred forms and elements of the present invention in detail, various general aspects of the invention will be discussed.

In a first aspect, a winch rotator 10 is provided for a receiver hitch mounted all terrain vehicle winch 12 having a winch cable 14 and a cable guiding fairlead 16 through which the winch cable 14 is threaded. The rotator 10 includes an auxiliary receiver hitch post 20 configured to be mounted to the receiver hitch 13. A support 22 mounted to the receiver hitch post 20 and extends in a substantially transverse manner therefrom to an end 24. A winch mount 26 on the support 22 is configured to mount the winch 12 with the fairlead 16 thereof oriented in a rotated, downwardly disposed position.

In another aspect, a receiver hitch winch 12 and winch rotator 10 is provided for an all terrain vehicle 11 having a receiver hitch 13 mounted thereon. The winch and rotator combination include a winch 12 having a winch drum 15 with winch line 14 spooled thereon. A fairlead 16 is provided on the winch, with fairlead guides, such as the exemplary rollers 17 illustrated, between which the winch line 14 is threaded along a reference axis X. A receiver hitch post 19 is mounted to the winch 12 in substantial perpendicular relation to the reference axis X, and is configured to be releasably secured to the receiver hitch 13 such that the reference axis X is substantially horizontal. An auxiliary receiver hitch post 20 is releasably receivable in the receiver hitch 13. A support 22 is mounted to the auxiliary receiver hitch post 20 and a winch mount 26 is provided on the support 22, shaped to releasably receive and mount the receiver hitch post 19 in an orientation in which the reference axis X is substantially upright.

In a further aspect, a process is provided for mounting a receiver hitch winch 12 in a rotated position to a receiver hitch 13 of an all terrain vehicle 11. The process includes the step of removing the receiver hitch winch 12 from the receiver hitch 13. Another step includes, mounting a receiver hitch rotator 10 (having an auxiliary receiver hitch post 20, a support 22 and a winch mount 26) to the receiver hitch 13 with the winch mount 26 in a rotated position from the receiver hitch 13. A further step (not necessarily in the order presented herein) includes mounting the receiver hitch winch 12 to the winch mount 26.

Figure 2:
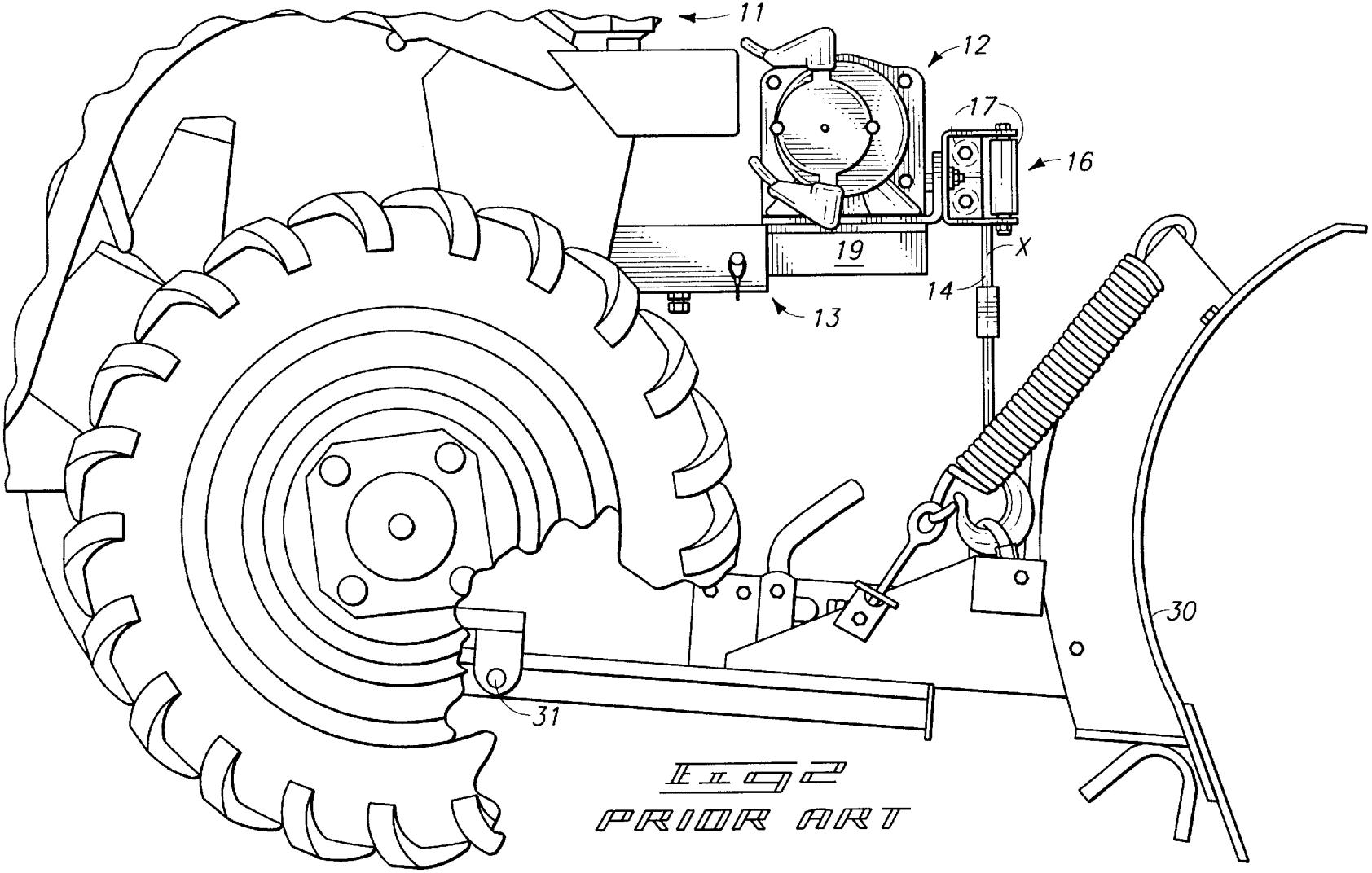
FIG 2 PRIOR ART
FIG. 2 is a view similar to FIG. 1 only showing the blade in a lowered operative position as effected by operation of the winch.

FIGS. 1 and 2 show portions of an ATV 11 mounting a receiver hitch winch 12 on a receiver hitch 13. The ATV 11 as illustrated also mounts an accessory plow 30 that is releasably secured to the ATV 11 and will move about a pivot 31 between a lowered, operative position as shown in FIG. 2, and an elevated position shown in FIG. 1. In order to accomplish this movement, the receiver hitch winch 12 is used with its cable connected to the plow. The orientation of the winch with respect to the plow forces the winch cable to assume a substantially vertical position and to form in a very sharp bend over one of the fairlead rollers 17. During operation, constant flexing of the winch cable over the relatively small radius of the fairlead 16 will cause premature work-hardening and breakage of the cable.

The present winch rotator 10 is provided specifically to eliminate this problem, by orienting the winch 12 in a rotated position such that the winch cable 14 may extend substantially vertically from the winch drum without bending sharply over any of the fairlead rollers 17 or other guide surface. The remainder of the figures (FIGS. 3–8) illustrate preferred example of a rotator and rotator/winch combination that will effectively mount a receiver hitch winch in the preferred, rotated position in order to reduce or eliminate wear on the winch cable 14.

Figure 3:
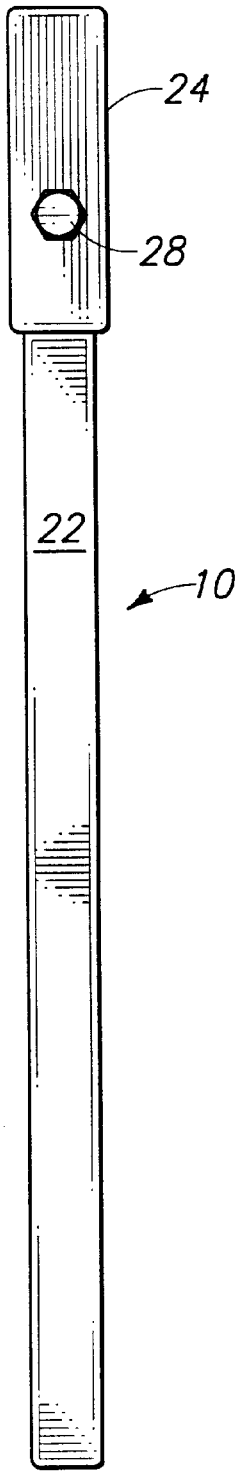
FIG. 3 is a front elevation view of a preferred winch rotator.
Figure 4:
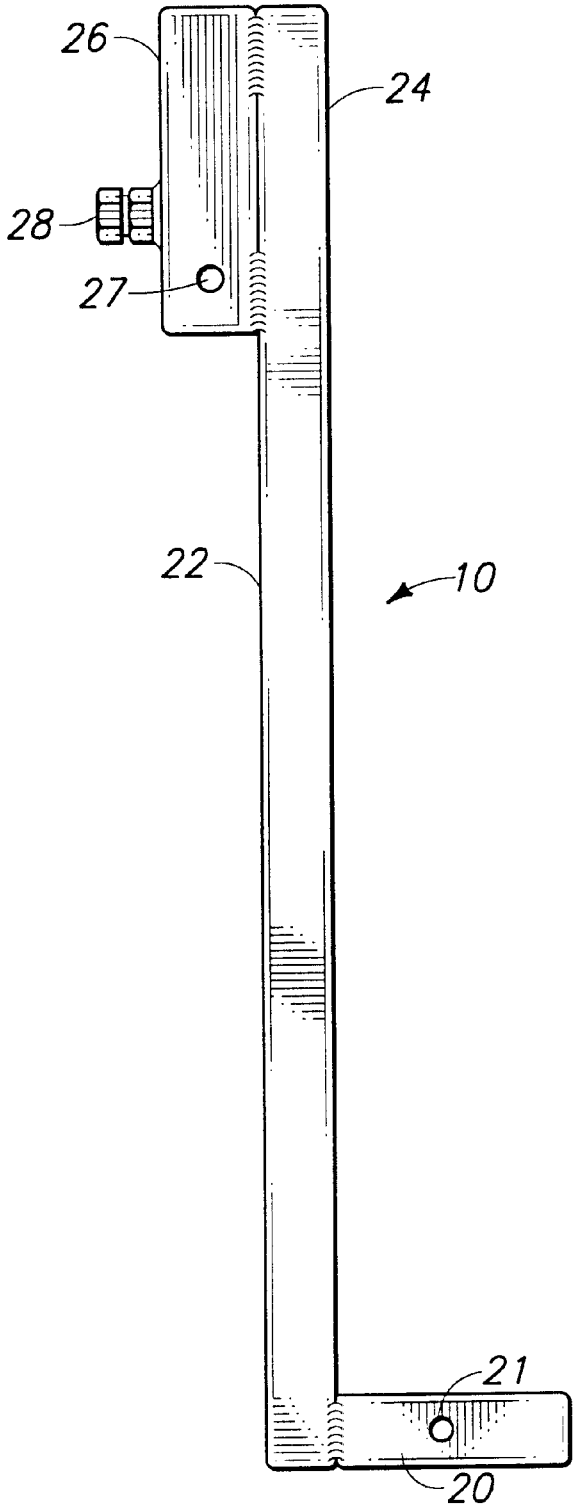
FIG. 4 is a side elevation view of the exemplary rotator shown in FIG. 3 as viewed from the right.
Figure 5:
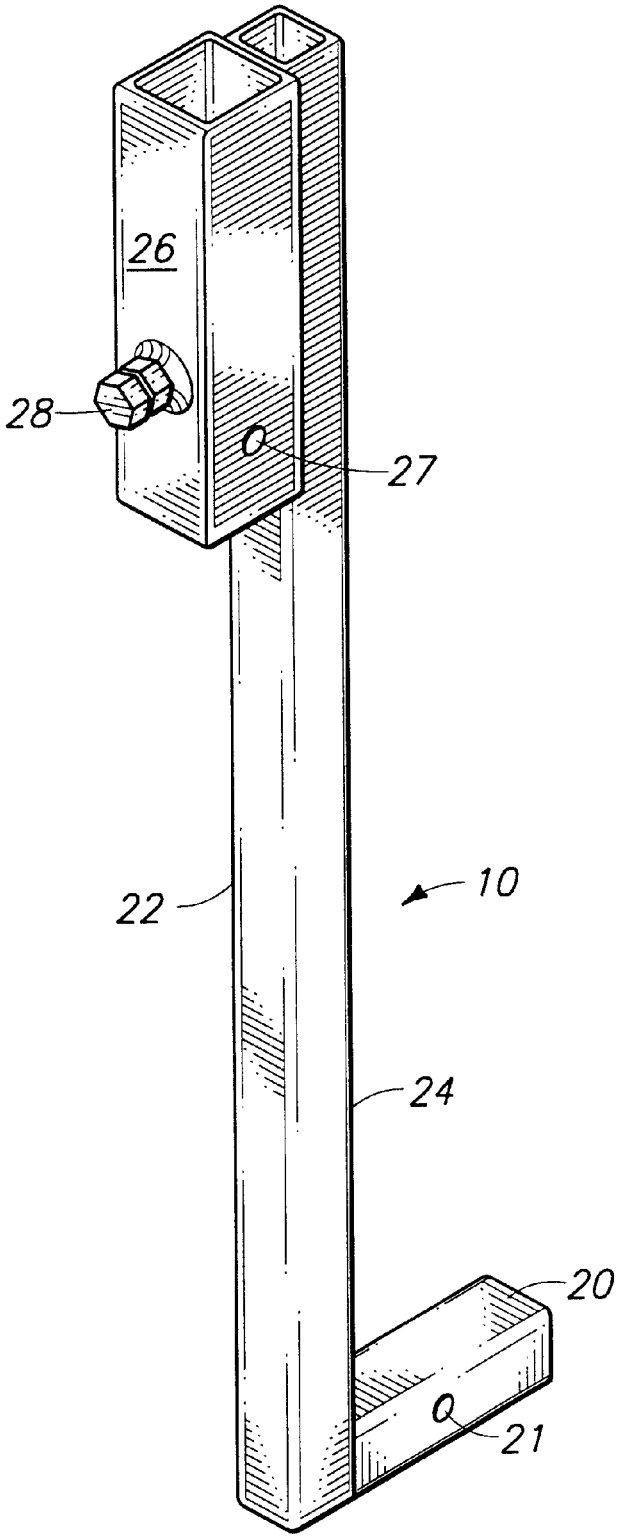
FIG. 5 is a perspective view of the exemplary rotator shown in FIGS. 3 and 4.

The earlier defined rotator 10, as illustrated by the examples in FIGS. 3–5, includes structure that is preferably formed of a rigid material such as steel channel or tubing. The dimensions of the various components may vary according to the nature of the ATV and/or the accessory (such as the plow 30) to which the winch cable is to be attached. The auxiliary hitch post 20 is shaped at least similar to the receiver hitch post 19 for the receiver hitch winch 12 in order to be received within the receiver hitch 13.

It is pointed out that the fairlead 16 may take various forms, one of which is exemplified by the roller arrangement shown in the drawings by way of example. Other forms such as simple formed guide surfaces may also be used within the scope of this invention.

The auxiliary hitch post 20 may include one or more locking arrangements such as the locking pin receiving aperture illustrated at 21 through which a locking device such as a lock pin, cotter pin, bolt, etc. may be secured to effectively lock the auxiliary hitch post 20 in position within the receiver hitch 13.

The support 22 may be affixed as by welding or other appropriate fastener or fastening technique to the auxiliary receiver hitch 19. The support 22 as "substantially transverse", may be perpendicular to the auxiliary receiver hitch post 20, or be oriented at other angles depending upon the desired use for the rotator. Further, the support 22 and auxiliary hitch post 20 could be integral, with the post 20 being bent or integrally formed with the support.

The upper or remote end of the support 22 preferably secures the winch mount 26. The mount 26 may be formed substantially identically to the receiver hitch 13 and may be provided with a lock pin aperture 27 intended to receive a locking pin, bolt, screw, or equivalent device to releasably lock the receiver hitch post in position within the winch mount. In addition, a bolt clamp 28 arrangement may be provided to assure secure mounting.

Opposite ends of the mount 26 are preferably open, thereby allowing the receiver hitch post 19 and winch 12 to be mounted in either end. Preferred use is shown, with the post 19 inserted in the bottom opening of the mount 26, in order to orient the cable 14 vertically between the fairlead rollers 17. It is possible in some situations however, to mount the post 19 and winch in the top end of the mount if for some reason it becomes desirable to extend the winch cable in a vertical upward direction.

Figure 6:
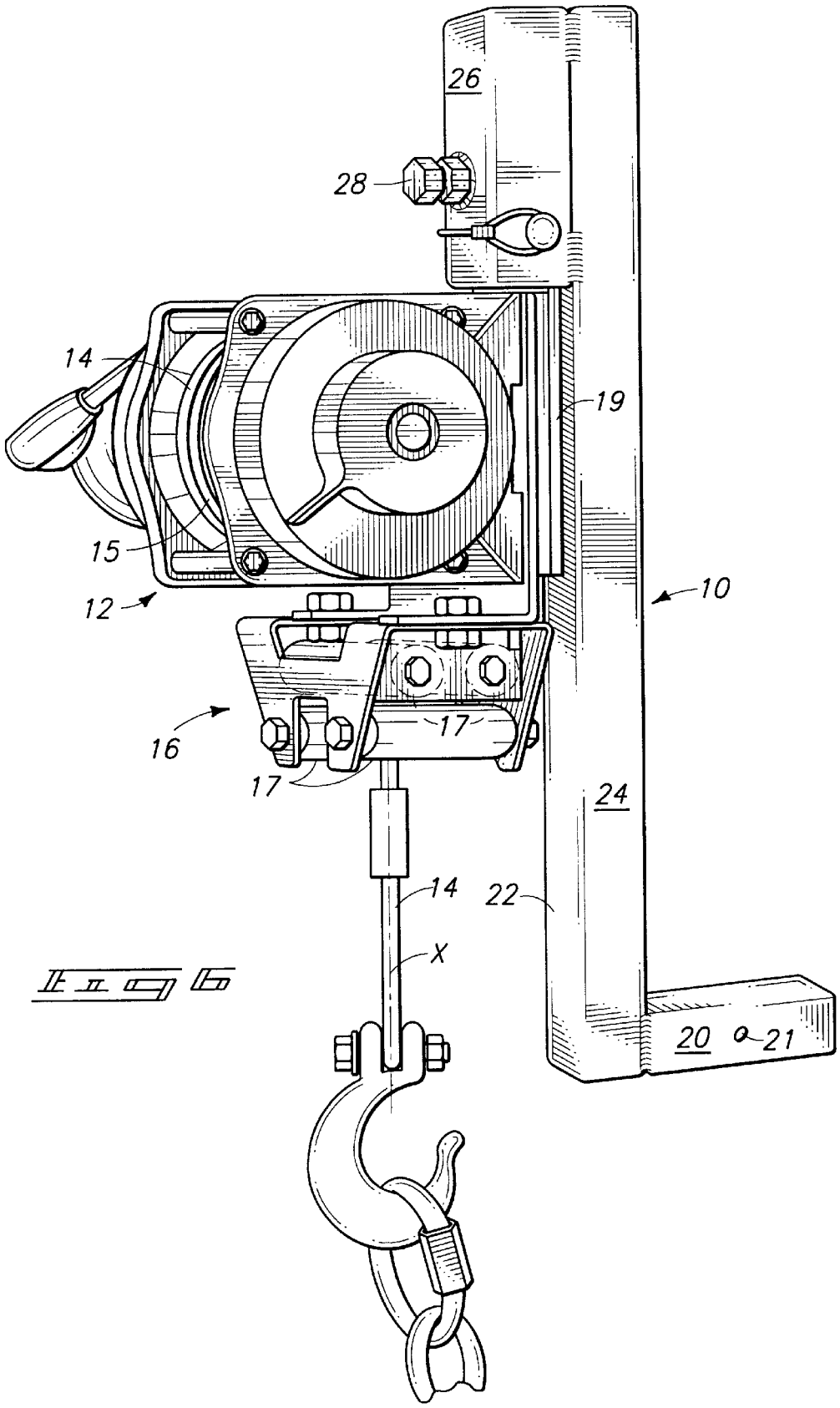
FIG. 6 is a perspective view of a combined winch and winch rotator.
Figure 7:
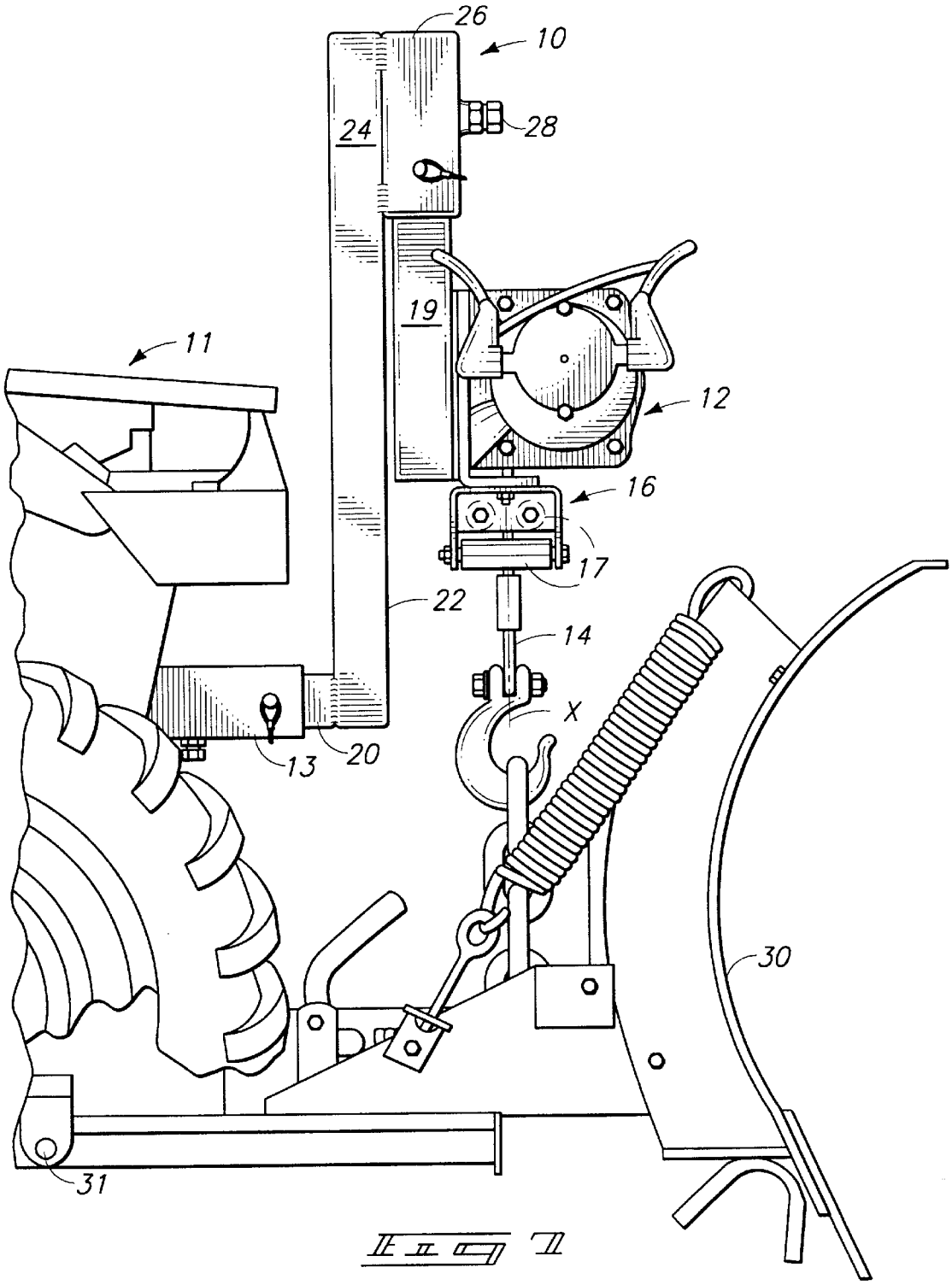
FIG. 7 is a fragmented view showing the exemplary rotator and winch mounted to an ATV and with a plow blade carried in a raised position.
Figure 8:
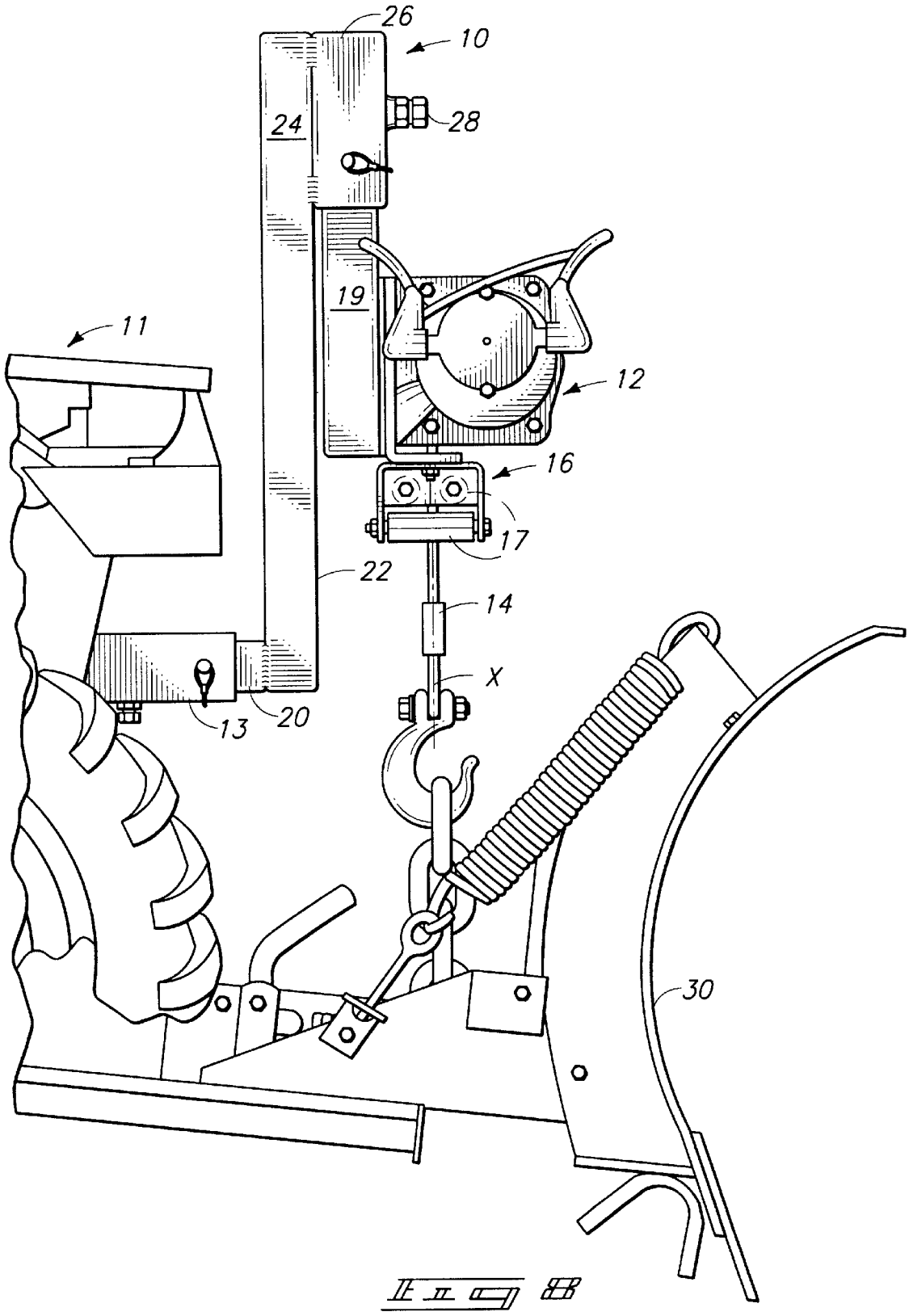
FIG. 8 is a view similar to FIG. 2 only showing the plow blade lowered.
Figure 9:
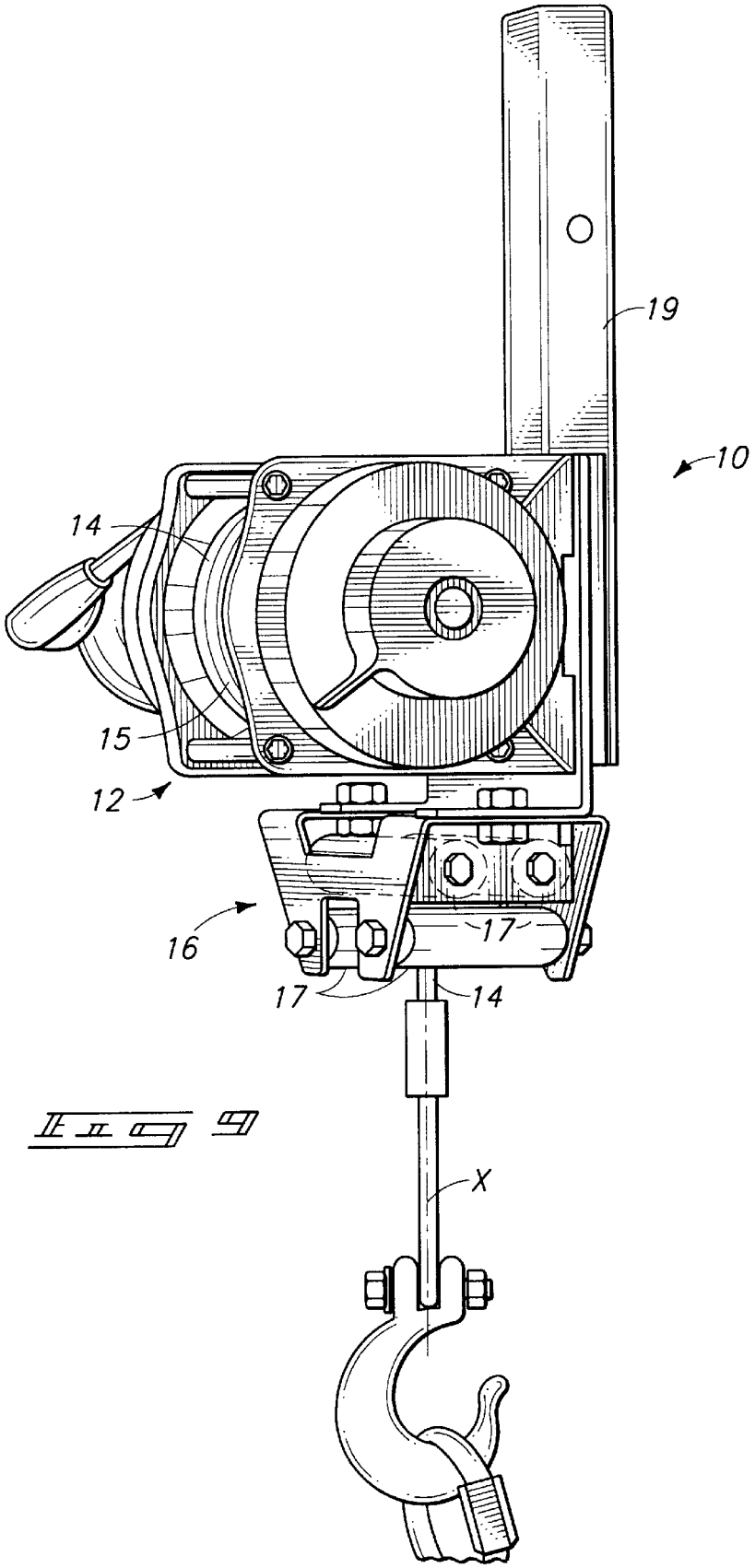
FIG. 9 is a view of a receiver hitch winch.

It is pointed out that a combination may be made in which the rotator 10 is provided as a kit or assembly in combination with the receiver hitch winch 12. FIG. 6 illustrates such a combination. It is also possible, however, to simply provide the rotator 10 substantially as shown in FIGS. 3–5.

In operation, and in practice of the procedural steps, we will assume that the receiver hitch winch is mounted to an ATV in the position as substantially shown in FIGS. 1 and 2. In order to mount the rotator 10, the first step is to remove the receiver hitch winch 12 from the receiver hitch 13. This is done simply by removing the appropriate engaged lock bolts, pins, etc. that will facilitate sliding separation of the receiver hitch post 19 from the receiver hitch 13. The winch is now pulled away from the receiver hitch and the preferred winch rotator may be mounted in its place. This is done simply by sliding the auxiliary receiver hitch post 20 into the receiver hitch 13.

Once in position, the various locking mechanisms, pins, bolts, etc., may be used to secure the rotator in position on the ATV 11. However, it may well be that prior to the above step, the user may prefer to attach the receiver hitch winch 12 to the winch mount 26. This is done simply by inserting the winch receiver hitch post 19 into the winch mount 26 (with the support in an upright orientation) and subsequently securing the associated locking arrangements to hold the winch 12 securely in position on the rotator 10.

Of course, appropriate electrical connections may be made at this point as well to facilitate use of the winch, preferably for the process of lifting and lowering implements such as the plow blade 30. The winch cable 14 will now extend substantially vertically between the fairlead guides. The winch cable can be connected to the auxiliary tool such as the illustrated plow blade 30 so that operation of the winch will take up and let out the cable 14 substantially along the axis X.

From the above, it may be seen that the rotator permits ordinary use of the lifted or otherwise controlled tool, without bending the winch line severely over the fairlead rollers 17.

It is pointed out that other advantages exist in addition to the elimination of the cable bend. The present rotator repositions the winch at a higher elevation such that the connected tool (plow 30) may be lifted to a higher inoperative elevation. This will allow for greater maneuverability for the associated ATV.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A winch rotator for a receiver hitch mounted all terrain vehicle winch having a winch cable and a cable guiding fairlead through which the winch cable is threaded, the rotator comprising:

an auxiliary receiver hitch post configured to be mounted to the receiver hitch;

a support mounted to the auxiliary receiver hitch post and extending in a substantially transverse manner therefrom to an end;

a winch mount on the support, configured to mount a winch with the fairlead thereof oriented in a rotated, downwardly disposed position.

2. The winch rotator of claim 1, wherein the support is elongated and extends to said one end, and wherein the winch mount is disposed at said end.

3. The winch rotator of claim 1 wherein the support is substantially perpendicular to the auxiliary receiver hitch post.

4. The winch rotator of claim 1 wherein the winch mount is comprised of an open channel member defining a formed receiver hitch post receiving socket.

5. The winch rotator of claim 1 wherein the support is elongated and wherein the winch mount is comprised of an open channel member defining a formed socket that is substantially parallel to the support.

6. The winch rotator of claim 1 wherein the winch mount includes a releasable lock pin and pin receiving aperture, disposed to receive and secure a receiver hitch post part of the winch.

7. A receiver hitch winch and winch rotator for an all terrain vehicle having a receiver hitch mounted thereon, the winch and rotator comprising:

a winch including a winch drum with winch line spooled thereon;

a fairlead on the winch including fairlead rollers between which the winch line is threaded along a reference axis;

a receiver hitch post mounted to the winch;

an auxiliary receiver hitch post releasably receivable in the receiver hitch;

a support mounted to the auxiliary receiver hitch post; and a winch mount on the support, shaped to releasably receive and mount the receiver hitch post in an orientation in which the reference axis is substantially upright.

8. The receiver hitch winch and winch rotator for an all terrain vehicle as defined by claim 7 wherein the support is elongated and extends to and end and wherein the winch mount is situated adjacent to said end.

9. The receiver hitch winch and winch rotator of claim 7 wherein the winch mount is comprised of an open channel member defining a formed socket shaped to releasably receive the receiver hitch post.

10. The receiver hitch winch and winch rotator of claim 7 wherein the support is elongated and the winch mount is comprised of an open channel member defining a formed socket that is substantially parallel to the support.

11. The receiver hitch winch and winch rotator of claim 7 wherein the support is elongated and substantially perpendicular to the auxiliary receiver hitch post.

12. The receiver hitch winch and winch rotator of claim 7 wherein the auxiliary receiver post, the support, and the winch mount are formed of rectangular channel.

13. The receiver hitch winch and winch rotator of claim 7 wherein the winch mount includes a lock pin and a lock pin receiving aperture configured to releasably secure the receiver hitch post to the winch mount.

* * * * *

UNITED STATES PATENT AND TRADEMARK OFFICE

CERTIFICATE OF CORRECTION

PATENT NO. : 6,634,588 B1
DATED : October 21, 2003
INVENTOR(S) : Stephen L. Jackson It is certified that error appears in the above-identified patent and that said Letters Patent is hereby corrected as shown below:

Column 1,
Line 21, the “are” should be deleted

Column 6,
Line 17, “and” should be -- an --.

Signed and Sealed this

Seventeenth Day of August, 2004

JON W. DUDAS
*Acting Director of the United States Patent and Trademark Office*